United States Patent [19]

Chehovah

[11] 4,294,551

[45] Oct. 13, 1981

[54] SERIES-PARALLEL PRINT MECHANISM FOR PRINTER

[75] Inventor: Felix Chehovah, Paris, France

[73] Assignee: Thomson-CSF, Paris, France

[21] Appl. No.: 78,804

[22] Filed: Sep. 25, 1979

[30] Foreign Application Priority Data

Sep. 29, 1978 [FR] France ..... 78 27921

[51] Int. Cl.[3] ..... B41J 3/10; B41J 3/16

[52] U.S. Cl. ..... 400/119; 101/93.04; 346/162

[58] Field of Search ..... 400/118–121; 101/93.04, 93.09; 346/162–165

[56] References Cited

U.S. PATENT DOCUMENTS

| | | | |
|---|---|---|---|
| 3,644,931 | 2/1972 | Stringer et al. | 346/165 X |
| 3,797,387 | 3/1974 | Decker et al. | 101/93.09 |
| 4,024,506 | 5/1977 | Spaargaren | 101/93.04 X |

*Primary Examiner*—Paul T. Sewell

*Attorney, Agent, or Firm*—Roland Plottel

[57] ABSTRACT

A print mechanism of the series-parallel type for a line printer permits the displacement at a substantially constant speed of an electrode holder carrying in electrodes each of which can print k consecutive points of a line. An electrical signal for the control of printing by electrodes is supplied by a photodetector which intercepts the light emitted by a light source through one of the k holes in a movable plate, whose displacement is linked with that of the electrode holder.

2 Claims, 2 Drawing Figures

SERIES-PARALLEL PRINT MECHANISM FOR PRINTER

BACKGROUND OF THE INVENTION

The present invention relates to print mechanisms of the series-parallel type and in particular to those permitting the printing of an electrosensitive printer paper.

Printers of the series-parallel type having N styluses each simultaneously printing a sequence of n consecutive points per line are well known.

In the case of photocopiers the printing of one line of a sheet of A4 paper requires, according to notice T4 of C.C.I.T.T., 1728 points to be printed in a time of about 30 ms, the distance between each point of 0.125 mm having a tolerance of ±0.015 mm. The known series-parallel printers are neither sufficiently rapid nor sufficiently accurate to permit this type of printing.

BRIEF SUMMARY OF THE INVENTION

The problem of the present invention is to obviate these disadvantages.

According to the invention this problem is solved by a series-parallel print mechanism permitting the printing of lines of m (m=kn with k and n being positive integers greater than 1) characters on an electrosensitive paper, wherein it comprises n electrodes which can print simultaneously, each being able to print a sequence of k consecutive characters per line, an electrode holder linked with the n electrodes, means for displacing the electrode holder at a substantially constant speed for the time of printing one line and means for fixing the position of each character to be printed during this displacement.

BRIEF DESCRIPTION OF THE DRAWINGS

The invention will be described in greater detail hereinafter relative to non-limitative embodiments with reference to the attached drawings, wherein show.

DETAILED DESCRIPTION OF THE PREFERRED EMBODIMENTS

Figure 1:
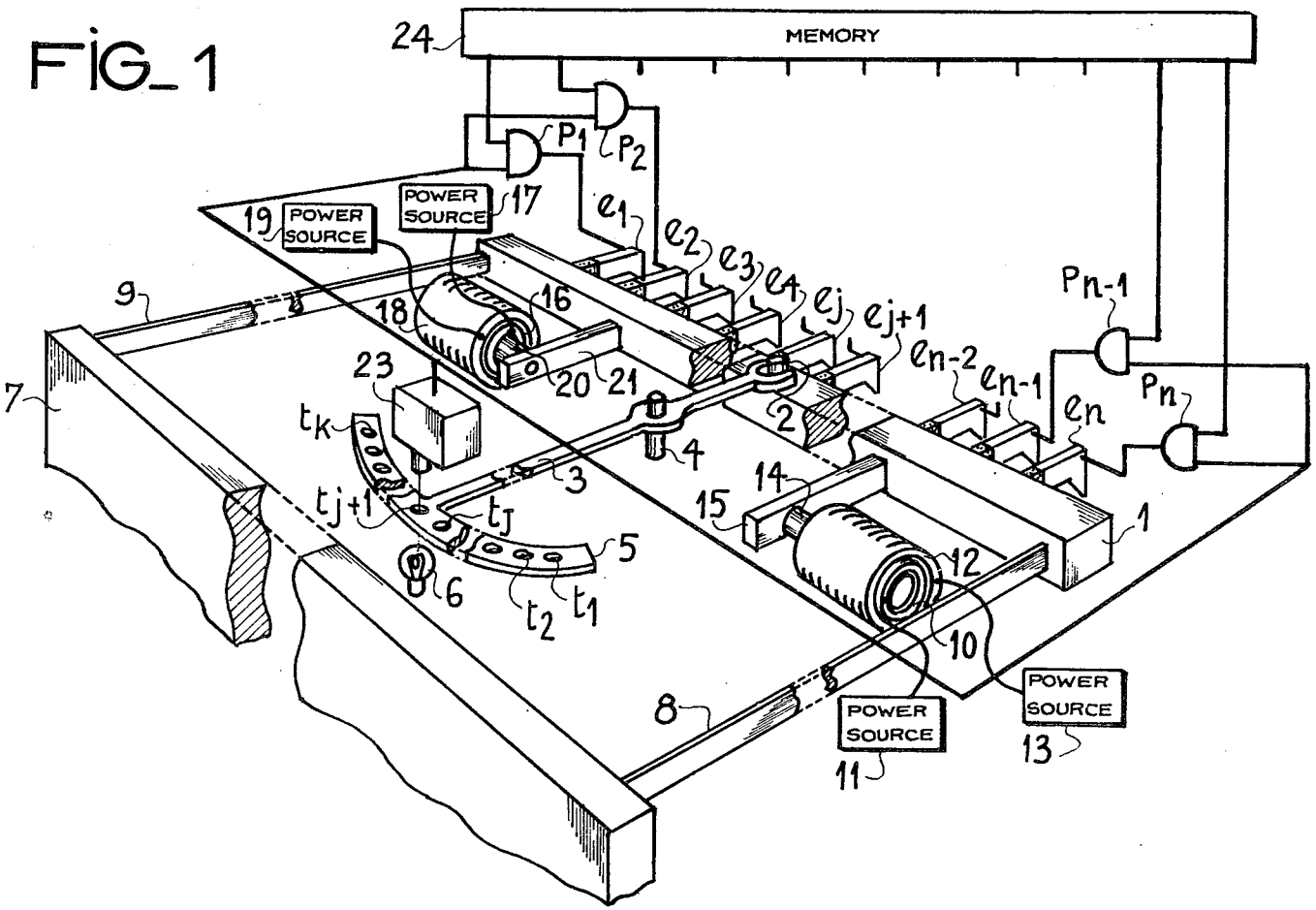
FIG. 1 a diagram of an embodiment of the mechanism according to the invention.

In FIG. 1 two flexible strips 8 and 9 are respectively fixed by one of their ends to the extremities of an electrode holder 1 and by the other of their ends to a fixed support 7. In the rest position these strips are perpendicular to the planes of the electrode holder 1 and the fixed support 7.

A pin 4 and the coils 10, 12, 16 and 18 energized respectively by the power sources 11, 13, 17 and 19 are integral with the fixed support 7, which is not shown in this drawing. In the same way a light source 6, a photodetector 23, AND-gates $P_1$ to $P_n$ and a memory 24 are also fixed to fixed support 7.

Electrode holder 1 comprises n electrodes $e_1$ to $e_n$ having a first end fixed to the electrode holder 1 and a second end in contact with an electrosensitive paper (not shown) these electrodes $e_1$ to $e_n$ comprise a non-dotted area symbolizing an electrical conductor and a dotted area symbolizing an insulant electrically insulating the electrodes from one another. The conductive part of each electrode $e_j$ (j=1 . . . n) receives the output signal from the corresponding AND-gate $P_j$ (j−1 . . . n). At a first input each gate $P_j$ receives an output signal from a memory 24 and at the other input the output signal from a photodetector 23.

The electrode holder 1 also has two supports 15 and 21 for soft iron cores 14 and 20. These soft iron cores are subject to the action of a magnetic field created by autonomous coils 10 and 12 for core 14 and 16 and 18 for core 20. The four coils represented in this way symbolise four coils surrounding their respective iron core about which they are arranged. These two identical assemblies make it possible to obtain small displacements of the electrode holder 1, which will be explained hereinafter.

A rod 3, able to pivot about the fixed pin 4, supports at a first end a plate 5 having k holes $t_1$ to $t_k$. The rotational movement of rod 3 is linked with small displacements of the electrode holder 1, due to the fact that the second end of rod 3 partially surrounds a pin 2, which is fixed to the electrode holder 1. The light source 6 illuminates the plate 5, whose holes permit the successive excitation of photodetector 23, during the small displacements of electrode holder 1.

Series-parallel print mechanisms of the above-described type permit the simultaneous printing of n characters as a result of the n electrodes $e_1$ to $e_n$. This printing is repeated k times during the small displacements of the electrode holder 1 carried out at an approximately constant speed. As a result the printing of one line comprises n×k=m characters. In the present embodiment n−144, k=12 and m=1728.

The simultaneous printing of n characters is performed by n electrodes $e_1$ to $e_n$, when each of which receives an electrical signal from their corresponding gate $P_j$ (j=1 . . . n), due to the fact that the second end of said electrodes is in contact with the electrosensitive paper.

The printing of k−1 further characters is carried out during the small displacements of the electrode holder 1. Electrode holder 1 can in fact be displaced to the right or left of its equilibrium position due to the flexible strips 8 and 9 connecting it to the fixed support 7. These small displacements are substantially rectilinear because their amplitude is small compared with the length of strips 8 and 9. The small displacements to the right are controlled by the magnetic field of coils 10 and 16, respectively excited by power sources 11 and 17. The small displacements to the left are controlled by the magnetic field of coils 12 and 18, respectively excited by power sources 13 and 19.

During the displacement of electrode holder 1 rod 3 causes plate 5 to rotate with it. When the light beam emitted by source 6 traverses a hole in plate 5 photodetector 23 emits a logic signal which opens the gates $P_j$ (j=1 . . . n) permitting the data, stored in memory 24 to be applied to the corresponding electrodes $e_j$ (j=1 . . . n). Here the gap between each hole in plate 5 is equal to h×0.125 mm, h being the mechanical amplification equal to the ratio of the distance separating each hole of plate 5 from pin 4 and that separating the pins 4 and 2.

Figure 2:
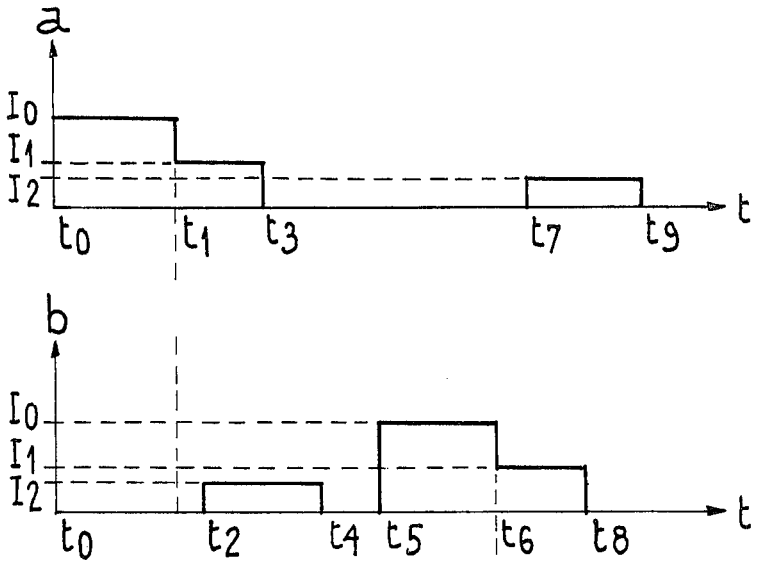
FIG. 2 a chronogram of signals permitting the explanation of the operation of the mechanism of FIG. 1.

The uniform movement is obtained from the current supplied by power sources 11 and 13 on the one hand and 17 and 19 on the other, whose chronograms are shown in FIG. 2.

In FIG. 2 a signal a symbolises the current supplied by power sources 11 and 17 and a signal b symbolises the current supplied by power sources 13 and 19.

At time $t_o$ coils 10 and 16 are voilently excited by signal a, which represents a current of value $I_o$ constant up to time $t_1$, and then by a current of value $I_1$ up to time $t_3$. The reduction in the value of the excitation current of these coils decreases the displacement speed to the right of electrode holder 1. This braking is increased by signal b representing a current of value $I_2$ exciting coils 12 and 18 between times $t_2$ and $t_4$ in a direction such that the magnetic field created by this current produces an action which opposes the preceeding action. The cycle is repeated between times $t_5$ and $t_9$, but for a displacement to the left.

An improvement in the uniform movement of electrode holder 1 during the printing time of one line is obtained by imposing a 2.5 mm displacement of electrode holder 1 between the two extreme positions, whilst the printing of 12 characters only requires a displacement of 1.5 mm.

It should be noted that the writing of a random line is carried out during the displacement from left to right, whilst that of the following line takes place during the following displacement from right to left.

Experience has shown and calculations have confirmed that these currents associated with the resistance of flexible strips 8 and 9 lead to a displacement with a substantially constant speed in each direction for the printing time of k characters.

It should be noted that this printing process can also be used with a series-parallel reading device. In this case the reading device has n photosensitive elements able to read k consecutive points during a displacement at constant speed of the reading device. It also has precise position fixing means, constituted by a clock for sampling the readings.

The invention is not limited to the embodiment described and represented and in particular the device can be constructed with the following variants.

The means permitting the control of small displacements of electrode holder 1 can be constituted by a single soft iron core provided with two coils excited by their respective power sources.

The position fixing means for each character to be printed constituted by rod 3 and plate 5 associated with an optical reader can be replaced by an optical reader associated with two parallel patterns, each constituted by an alternating sequence of black and white marks of the same width, one of said patterns being integral with the electrode holder 1 and the other fixed. As the lines of one pattern are parallel to those of the other pattern the optical reader will supply an electrical signal whenever the black and white lines of the two patterns coincide. However, in this case the width of the lines must be 0.0625 mm (i.e. equal to half the space between two points to be printed).

These position marking means for each character to be printed may also comprise a single pattern having black lines 0.125 mm apart, associated with an optical reader.

The means for the displacement of the electrode holder 1 can also be constituted by a continuously rotating motor associated with a clutch and a cam.

Print mechanisms of this type are particularly used in photocopiers.

What is claimed is:

1. A series-parallel print mechanism permitting the printing of lines of m ($m=Kn$ with k and n being positive integers greater than 1) characters on an electrosensitive paper, comprising n electrodes which can print simultaneously, each of said electrodes being able to print a sequence of k consecutive characters per line, an electrode holder linked with the n electrodes, means for displacing the electrode holder at a substantially constant speed for the time of printing one line, and means for fixing the position of each character to be printed during this displacement; a mechanical coupling member fixed to the electrode holder where the position fixing means comprise a plate having k holes, a fixed optical reading device, a fixed pin, a rod having first and second ends pivoting at a point located between its ends about the fixed pin, and whose first end is coupled with the mechanical coupling member and whose second end supports the plate having k holes, said holes and the optical reading device being disposed in such a way that for a displacement of the electrode holder corresponding to the printing of one line the optical reading device reads each of the k holes and whereby for each reading of a hole the reading device supplies an electrical control signal to permit the printing of one character by each of the n electrodes.

2. A print mechanism according to claim 1, wherein it comprises a fixed support and two flexible strips for respectively coupling each of the ends of the electrode holder with the fixed support.

* * * * *